US007728522B2

(12) United States Patent
Kang

(10) Patent No.: US 7,728,522 B2
(45) Date of Patent: Jun. 1, 2010

(54) PLASMA DISPLAY PANEL

(75) Inventor: Kyoung-Doo Kang, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 840 days.

(21) Appl. No.: 11/131,689

(22) Filed: May 17, 2005

(65) Prior Publication Data

US 2005/0258752 A1 Nov. 24, 2005

(30) Foreign Application Priority Data

May 19, 2004 (KR) ..... 10-2004-0035468

(51) Int. Cl.
*H01J 17/49* (2006.01)

(52) U.S. Cl. ..... 313/585; 313/584; 313/587

(58) Field of Classification Search ..... 313/582–587
See application file for complete search history.

(56) References Cited

U.S. PATENT DOCUMENTS

| | | | | |
|---|---|---|---|---|
| 6,333,599 | B1 * | 12/2001 | Kawanami et al. | 313/582 |
| 6,384,531 | B1 * | 5/2002 | Park et al. | 313/584 |
| 6,522,072 | B1 * | 2/2003 | Yura et al. | 313/582 |
| 6,531,819 | B1 | 3/2003 | Nakahara et al. | |
| 2001/0011974 | A1 | 8/2001 | Kang et al. | |
| 2004/0150340 | A1 * | 8/2004 | Son et al. | 313/582 |
| 2005/0029946 | A1 * | 2/2005 | Kwon et al. | 313/584 |

FOREIGN PATENT DOCUMENTS

| | | | |
|---|---|---|---|
| CN | 1249527 | A | 4/2000 |
| CN | 1264914 | A | 8/2000 |
| EP | 1 187 165 | A2 | 3/2002 |
| EP | 1 187 165 | A3 | 4/2005 |
| JP | 03-219528 | | 9/1991 |
| JP | 2000-251739 | | 9/2000 |
| JP | 2000-285812 | A | 10/2000 |
| JP | 2001-135243 | A | 5/2001 |
| JP | 2001-236895 | | 8/2001 |
| JP | 2002-260536 | | 9/2002 |

(Continued)

OTHER PUBLICATIONS

Patent Abstracts of Japan, Publication Number: JP 2004-039578; Publication Date: May 2, 2004; in the name of Hashikawa et al.

(Continued)

*Primary Examiner*—Bumsuk Won
(74) *Attorney, Agent, or Firm*—Christie, Parker & Hale, LLP

(57) ABSTRACT

A plasma display panel (PDP) which can realize low voltage driving, to thus reduce power consumption, and which can improve luminous efficiency through a long gap. The PDP includes a first substrate and a second substrate opposing each other, barrier ribs arranged in a space between the first substrate and the second substrate to define a plurality of discharge cells, phosphor layers formed in each of the plurality of discharge cells, address electrodes formed on the second substrate, and display electrodes provided on the first substrate. The display electrodes include igniter electrodes having ends protruding towards insides of the discharge cells, the igniter electrodes opposing the address electrodes within the discharge cells.

20 Claims, 5 Drawing Sheets

FOREIGN PATENT DOCUMENTS

| | | |
|---|---|---|
| JP | 2002-367521 | 12/2002 |
| JP | 2003-036792 | 2/2003 |
| JP | 2004-39578 | 2/2004 |
| KR | 2000-0057765 | 9/2000 |

OTHER PUBLICATIONS

Patent Abstracts of Japan, Publication No. 2002-260536, Date of publication of application Sep. 13, 2002, in the name of M. Okikawa.

Patent Abstracts of Japan, Publication No. 2002-367521, Date of publication of application Dec. 20, 2002, in the name of H. Tono.

Patent Abstracts of Japan, Publication No. 2003-036792, Date of publication of application Feb. 7, 2003, in the name of K. Amamiya.

European Patent Search Report dated Aug. 10, 2005 for Application No. EP 05 10 4249, in the name of Samsung SDI Co., Ltd.

Patent Abstracts of Japan, Publication No. 2000-251739; Date of Publication: Sep. 14, 2000; in the name of Masakimi Nakahara et al.

Korean Patent Abstracts, Publication No. 1020000057765 A; Date of Publication: Sep. 25, 2000; in the name of Masahiro Nakahara et al.

* cited by examiner

PLASMA DISPLAY PANEL

CROSS-REFERENCE TO RELATED APPLICATION

This application claims priority to and the benefit of Korean Patent Application No. 10-2004-0035468 filed in the Korean Intellectual Property Office on May 19, 2004, the entire content of which is incorporated herein by reference.

BACKGROUND OF THE INVENTION

1. Field of the Invention

The present invention relates to a plasma display panel (PDP) for display an image.

2. Description of the Related Art

Generally, a PDP is a display device in which vacuum ultraviolet (VUV) rays emitted from the plasma generated by gas discharge excite phosphors to emit red, green, and blue visible light and thereby realize predetermined images. The PDP can provide a large-scale screen of more than 60 inches with a thickness of less than 10 centimeters. Since the PDP is a self emission display device, it typically has no distortion due to view angle and has outstanding color reproduction. Moreover, its manufacturing process is simpler than that of an LCD, so the PDP has advantages in productivity and cost. Accordingly, the PDP has been highlighted for televisions and flat panel displays for industrial purposes.

In a typical AC PDP, address electrodes are formed along one direction on a rear substrate, and a dielectric layer is formed on an entire surface of the rear substrate, covering the address electrodes. Over the dielectric layer, a plurality of barrier ribs are formed in a stripe pattern between each of the address electrodes, and red, green and blue phosphor layers are formed between each of the barrier ribs.

Further, display electrodes having a pair of transparent electrodes and a pair of bus electrodes, are typically formed in a direction intersecting the address electrodes on a surface of a front substrate opposing the rear substrate. A dielectric layer and an MgO protective layer are formed sequentially covering the display electrodes.

Discharge cells are defined in the region where the address electrodes on the rear substrate intersect a pair of the display electrodes on the front substrate.

In the aforementioned PDP, more than a million matrix type discharge cell units are arranged. To simultaneously drive matrix type discharge cells of an AC PDP, a memory characteristic is used which will be described in more detail below.

In order to induce discharge between an X electrode and a Y electrode, forming a pair of display electrodes, a potential difference of not less than a predetermined critical voltage is required. The predetermined critical voltage is referred to a firing voltage Vf. An address voltage Va is applied between the Y electrode and the address electrode, and the discharge occurs forming plasma within discharge cells. This occurs because electrons and ions in the plasma shift toward electrodes with opposite polarities, thereby permitting the flow of electric current.

Dielectric layers are formed on the respective electrodes of the AC PDP. Most of the charge carriers (for example, electrons or ions) are deposited on whichever of the dielectric layers has polarity opposite that of the charge carrier. The net potential between the Y electrode and the address electrode is smaller than the originally applied address voltage Va, so that the discharge becomes weak, resulting in dissipation of address discharge. In such a case, a relatively small amount of electrons is deposited on the X electrode, while a relatively large amount of ions is deposited on the Y electrode. The charge deposited on the dielectric layer covering the X and Y electrodes is a wall charge Qw. A space voltage formed between the X and the Y electrodes due to the wall charge is a wall voltage Vw.

Subsequently, when a predetermined voltage, that is, a discharge sustain voltage Vs, is applied between the X electrode and the Y electrode of the selected discharge cell, plasma discharge is effected when the sum of the discharge sustain voltage Vs and the wall voltage Vw, that is, (Vs+Vw), exceeds a discharge firing voltage Vf. Accordingly, vacuum ultraviolet rays (VUVs) are emitted from discharge gas excited by plasma discharge. The VUVs excite phosphors so that they emit visible light through the transparent front substrate.

However, if any address discharge is not induced between the Y electrode and the address electrode, that is, if the address voltage Va is not applied thereto, no wall charge is deposited between the X and Y electrodes. As a result, no wall voltage exists between the X and Y electrodes. In such a case, only the discharge sustain voltage Vs applied between the X and Y electrodes is made within the discharge cell. Since the discharge sustain voltage Vs is lower than the firing voltage Vf, the gas space between the X and Y electrodes may not cause the discharge.

The PDP driven in the above-described manner undergoes several operational steps from inputting of power to finally obtaining of visible light. In this regard, on the one hand, in order to initiate sustain discharge, the X and Y electrodes are required to be rather close to each other or a considerably high sustain discharge voltage needs to be applied thereto. On the other hand, in order to increase the luminous efficiency through excitation of phosphor layers formed on discharge cells, a long gap must be maintained throughout the area where sustain discharge takes place.

SUMMARY OF THE INVENTION

The present invention provides a plasma display PDP which can realize low voltage driving, to thus reduce power consumption, and which can improve luminous efficiency through a long gap.

According to an aspect of the present invention, there is provided a plasma display panel comprising a first substrate and a second substrate opposing each other, barrier ribs arranged in a space between the first substrate and the second substrate to define a plurality of discharge cells, phosphor layers formed in each of the plurality of discharge cells, address electrodes formed on the second substrate and extending along a first direction, and display electrodes provided on the first substrate, wherein the display electrodes include igniter electrodes having ends protruding towards insides of the discharge cells, the igniter electrodes opposing the address electrodes within the discharge cells.

The display electrodes include a pair of bus electrodes formed to correspond to the discharge cells while extending along a second direction intersecting the direction of the address electrodes on the first substrate, protrusion electrodes protruding toward centers of the discharge cells, and igniter electrodes protruding from the bus electrodes into the discharge cells to locate the ends between the protrusion electrodes, respectively.

The display electrodes may include a pair of an X electrode and a Y electrode are formed on the first substrate such that the pair of the X and Y electrodes corresponds to the discharge cells while extending along the second direction intersecting the address electrodes, and each of the X and Y electrodes include a pair of bus electrodes formed to correspond to the discharge cells while extending along the direction intersecting the length direction of the address electrodes on the first substrate, protrusion electrodes protruding toward the insides of the discharge cells from respective bus electrodes, and igniter electrodes protruding from respective opposing ones of the pair of bus electrodes and having ends located between the protrusion electrodes within the discharge cells.

The igniter electrodes may include expanded portions extending along the barrier ribs substantially parallel to the address electrodes, protruding portions protruding from the expanded portions toward the insides of the discharge cells, and opposing portions at ends of the protruding portions, each opposing portion configured to face a respective opposing portion from an opposing one of the pair of bus electrodes.

The opposing portions may have a width in the first direction greater than a width of the protruding portions while maintaining a predetermined space therebetween.

The opposing portions may have opposite sides of the same length in the first direction of the address electrodes. Alternatively, the opposing portions may have one relatively longer side than the opposite side.

The pair of opposing portions may have ends facing directions which cross at substantially a right angle with respect to the first direction.

The pair of opposing portions may have ends facing directions of which cross obliquely with respect to the first direction.

The X and Y electrodes of the igniter electrodes are formed to correspond to the centers of discharge cells.

The X and Y electrodes of the igniter electrodes may be formed to pass over the barrier ribs adjacent in the second direction, respectively.

The X and Y electrodes of the igniter electrodes may be symmetric to each other about a point of symmetry positioned at the centers of the discharge cells.

The igniter electrodes and the protruding portions and opposing portions thereof may be transparent electrodes.

In another aspect of the present invention, a sturcture for initiating sustain discharge in a plasma display panel is provided, the plasma display panel having a first substrate and a second substrate opposing each other, barrier ribs arranged in a space between the first substrate and the second substrate to define a plurality of discharge cells, phosphor layers formed in each of the plurality of discharge cells, address electrodes formed on the second substrate, and display electrodes formed on the first substrate, the display electrodes including pairs of bus electrodes with respective protrusion electrodes extending from respective bus electrodes into the discharge cells. Igniter electrodes are mounted to each of a respective pair of bus electrodes, the igniter electrodes having ends distal from the respective pair of bus electrodes and located between the protrusion electrodes, such that a gap between opposing faces of the ends may provide an initial sustain discharge in the respective discharge cell when a discharge sustain driving voltage is applied to the display electrodes. The opposing faces may be located between the protrusion electrodes such that the gap is at substantially a right angle with respect to the length direction of the address electrodes. The opposing faces may also be located between the protrusion electrodes such that the gap is oblique to the length direction of the address electrodes. Respective gaps may be formed to correspond to centers of respective discharge cells.

DETAILED DESCRIPTION

Figure 1:
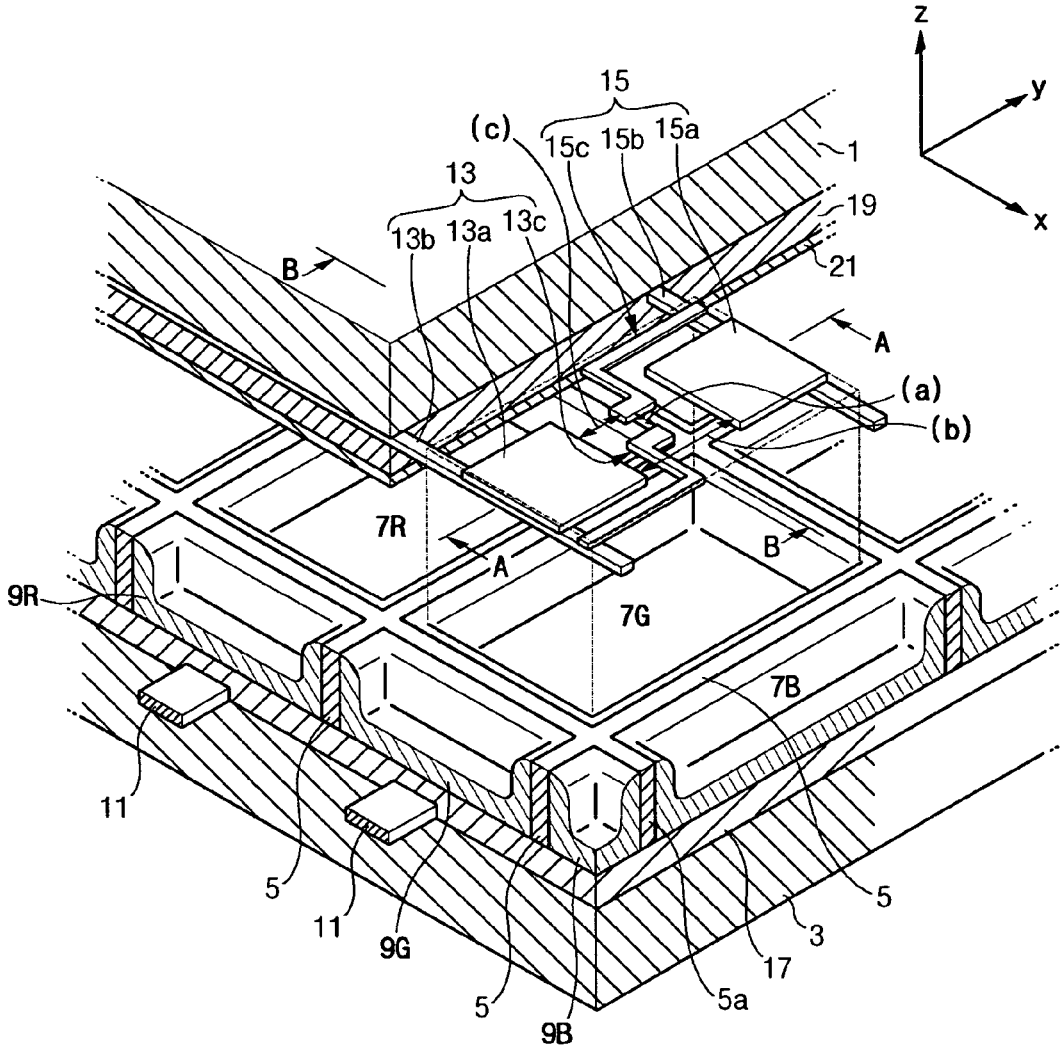
FIG. 1 is a schematic partial exploded perspective view of a PDP according to a first embodiment of the present invention.

Turning now to the drawings, referring to FIG. 1, a PDP according to a first embodiment of the present invention has a first substrate 1 and a second substrate 3 which are spaced apart at a predetermined distance while facing each other. In the space between both of the substrates 1 and 3, a plurality of discharge cells 7R, 7G, 7B in which plasma discharge takes place are defined by a plurality of barrier ribs 5. Red (R), green (G) and blue (B) phosphors are printed to form phosphor layers 9R, 9G, 9B in the discharge cells 7R, 7G, 7B.

A plurality of the address electrodes 11 are formed along the y-axis direction of the drawing of the second substrate 3 on a surface of the second substrate 3. A plurality of display electrodes 13 and 15 are formed along the direction intersecting the plurality of address electrodes 11, that is, along the x-axis direction of the drawing, on the second substrate 3.

Barrier ribs 5 provided in the space between the first substrate 1 and the second substrate 3 are arranged to be substantially parallel with adjacent barrier ribs 5. Other barrier ribs 5*a* are arranged to intersect with the barrier ribs 5 and are substantially parallel with one another. The discharge cells 7R, 7G, 7B are defined by the barrier ribs 5 and 5*a*.

While closed barrier ribs, i.e., the barrier ribs 5 and 5*a* intersecting each other in the y- and x-axis directions to form the discharge cells 7R, 7G, 7B, have been described in the above-illustrative embodiment, it should be noted that the invention is also be applied to other types of barrier ribs, such a striped barrier ribs.

Figure 2:
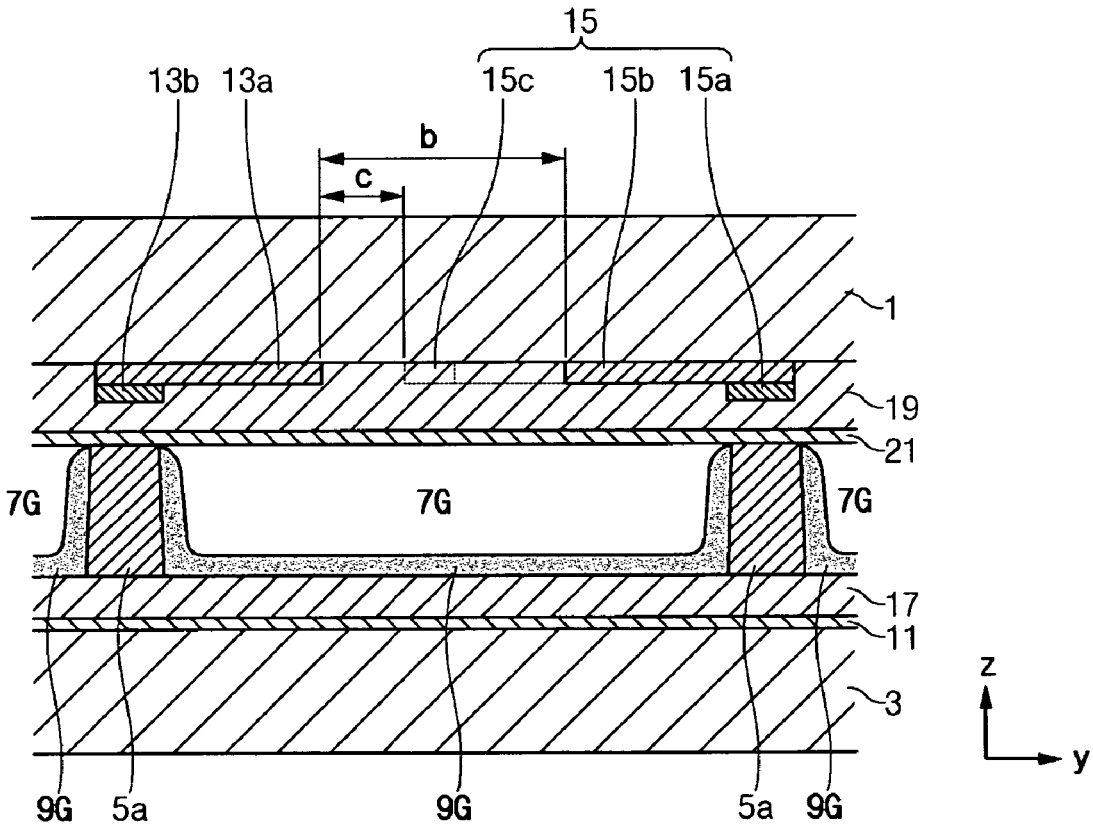
FIG. 2 is a partial sectional view taken along line A-A shown in FIG. 1.
Figure 3:
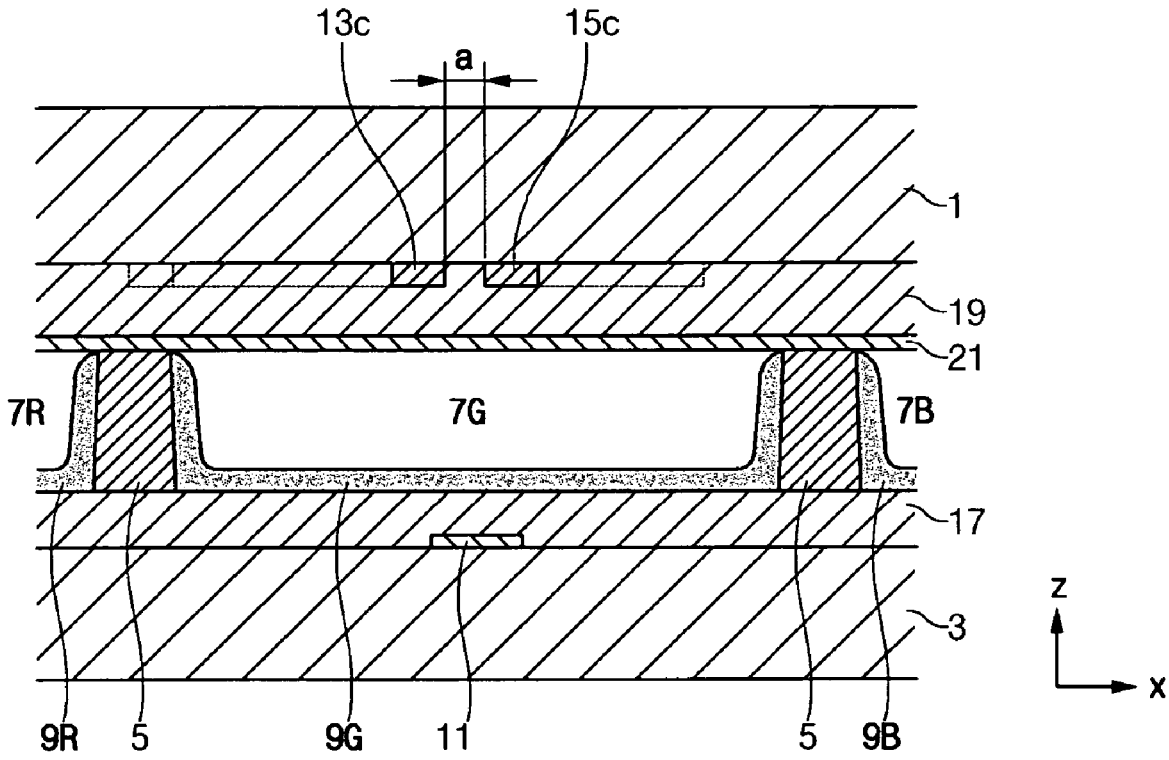
FIG. 3 is a partial sectional view taken along line B-B shown in FIG. 1.

FIG. 2 is a partial sectional view taken along line A-A shown in FIG. 1, and FIG. 3 is a partial sectional view taken along line B-B shown in FIG. 1.

The address electrodes 11 are covered by a first dielectric layer 17 to induce address discharge by forming wall charges in the discharge cells 7R, 7G, 7B. In an exemplary embodiment the first dielectric layer 17 is preferably formed of a white dielectric material to ensure sufficient reflectivity for visible light.

The display electrodes 13 and 15 include an X electrode 13 and a Y electrode 15 arranged to face and opposite to each other in view of the discharge cells 7R, 7G, 7B to cause sustain discharge in the discharge cells 7R, 7G, after the address discharge.

The X electrode 13 and Y electrode 15 include protrusion electrodes 13*a* and 15*a* protruding toward centers of the discharge cells 7R, 7G, 7B, bus electrodes 13*b* and 15*b* for supplying current to the protrusion electrodes 13*a* and 15*a*, and igniter electrodes 13*c* and 15*c* protruding from the bus electrodes 13*b* and 15*b* into the discharge cells 7R, 7G, 7B and having ends located between the protrusion electrodes 13*a* and 15*a*, respectively.

Here, the protrusion electrodes 13*a* and 15*a* serve to induce plasma discharge in the discharge cells 7R, 7G, 7B, and in an exemplary embodiment are transparent electrodes made of transparent ITO (Indium Tin Oxide) in order to achieve brightness.

The bus electrodes 13*b* and 15*b* are provided for ensuring electrical conductivity by compensating for high resistance of the protrusion electrodes 13*a* and 15*a*, and in an exmplary embodiment are formed of a metallic material such as Aluminum.

As described above, the igniter electrodes 13*c* and 15*c* are arranged between the protrusion electrodes 13*a* and 15*a*, and have ends protruding toward centers of the discharge cells 7R, 7G, 7B to face each other. The facing direction that is, the direction indicated by an arrow corresponding to the short gap (a), in which the ends of the igniter electrodes 13*c* and 15*c* face each other, is in the x-axis direction and crosses the length direction of the address electrodes 11 (the y-axis), in the discharge cells 7R, 7G, 7B.

Figure 4:
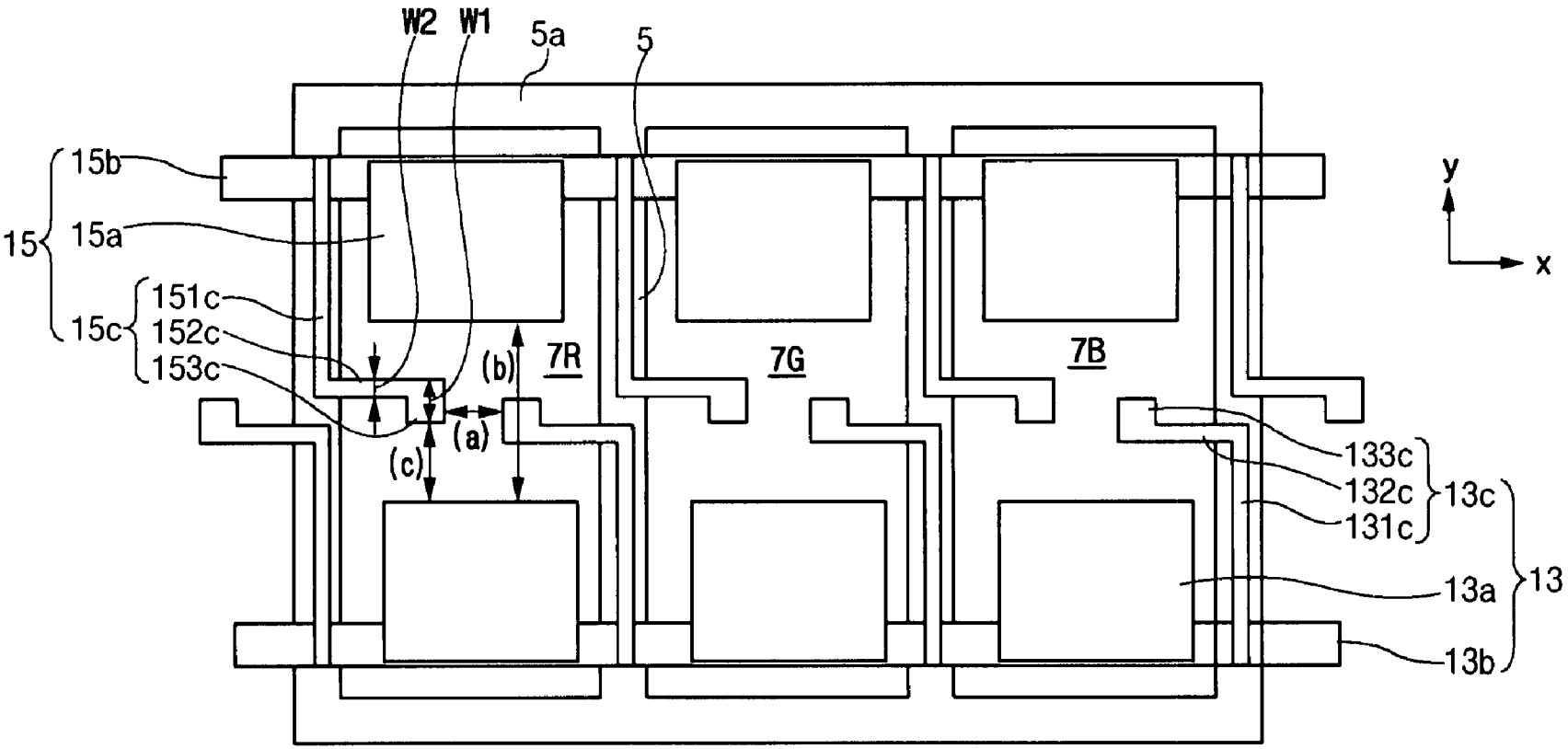
FIG. 4 is a partial plan view of FIG. 1.

FIG. 4 is a partial plan view of FIG. 1. The igniter electrodes 13*c* and 15*c* will now be described in more detail. The igniter electrodes 13*c* and 15*c* facilitate initial sustain discharge before sustain discharge starts in the display electrodes 13 and 15 consisting of the X and Y electrodes 13 and 15 with a long gap (b) therebetween. The igniter electrodes 13*c* and 15*c* has a short gap (a) maintained therebetween to induce initial sustain discharge.

As described above, the long gap (b) between the protrusion electrodes 13*a* and 15*a* improves discharge efficiency, while the short gap (a) between the igniter electrodes 13*c* and 15*c* enables long gapped sustain discharge, so that initial sustain discharge can be made by low voltage driving, thereby ultimately reducing power required for driving the PDP. The igniter electrodes 13*c* and 15*c* enables sustain discharge through the short gap (a) at an initial sustain discharge requiring a high voltage, and then the protrusion electrodes 13*a* and 15*a* realize regular sustain discharge through the long gap (b). In other words, after inducing initial sustain discharge, the igniter electrodes 13*c* and 15*c*, which are contiguous with the protrusion electrodes 13*a* and 15*a* by a distance (c), cause surface discharge with the protrusion electrodes 13*a* and 15*a*, thereby finally making the protrusion electrodes 13*a* and 15*a* realize sustain discharge through the long gap (b).

The igniter electrodes 13*c* and 15*c* include expanded portions 131*c* and 151*c* extending along the barrier ribs 5 substantially parallel to the length direction of the address electrodes 11 (the y-axis direction of the drawing), protruding portions 132*c* and 152*c* protruding from the expanded portions 131*c* and 151*c* toward the insides of the discharge cells 7R, 7G, 7B, and opposing portions 133*c* and 153*c* opposing ends of the protruding portions 132*c* and 152*c*.

In an exemplary embodiment the expanded portions 131*c* and 151*c* extending along the barrier ribs 5 are linearly formed. The protruding portions 132*c* and 152*c* allow the opposing portions 133*c* and 153*c* to be positioned within the discharge cells 7R, 7G, 7B and protrude from the expanded portions 131*c* and 151*c* toward the insides of the discharge cells 7R, 7G, 7B. As in the illustrative embodiment the protruding portions 132*c* and 152*c* may be formed linearly, or they may be in another form. The opposing portions 133*c* and 153*c* function as igniters in the discharge cells 7R, 7G, 7B to arouse initial sustain discharge by low voltage. The opposing portions 133*c* and 153*c* are provided at ends of the protruding portions 132*c* and 152*c* with a predetermined gap maintained therebetween to be positioned between the protrusion electrodes 13*a* and 15*c*.

The opposing portions 133*c* and 153*c* have a width w1 in the length direction of the address electrodes 11 (in the y-axis direction of the drawing) greater than a width w2 of the protruding portions 132*c* and 152*c*. Such a relationship between the widths w1 and w2 shortens the distance (c) between each of the opposing portions 133*c* and 153*c* and each of the protrusion electrodes 13*a* and 15*a* opposing thereto while maintaining the short gap (a) between the opposing portions 133*c* and 153*c*, thereby easily making the initial sustain discharge that has occurred at the opposing portions 133*c* and 153*c* lead to surface discharge occurring between the opposing portions 133*c* and 153*c* and between the protrusion electrodes 13*a* and 15*a*.

The opposing portions 133*c* and 153*c* are substantially perpendicular to the length direction of the address electrodes 11, that is, the direction indicated by an arrow corresponding to the long gap (b) (the y-axis direction) and in an exemplary embodiment have opposite sides of the same length. In such a case, the pair of opposing portions 133*c* and 153*c* have ends whose facing directions (the x-axis direction of the drawing) are at right angles with respect to the length direction of the address electrodes 11 (the y-axis direction).

Figure 5:
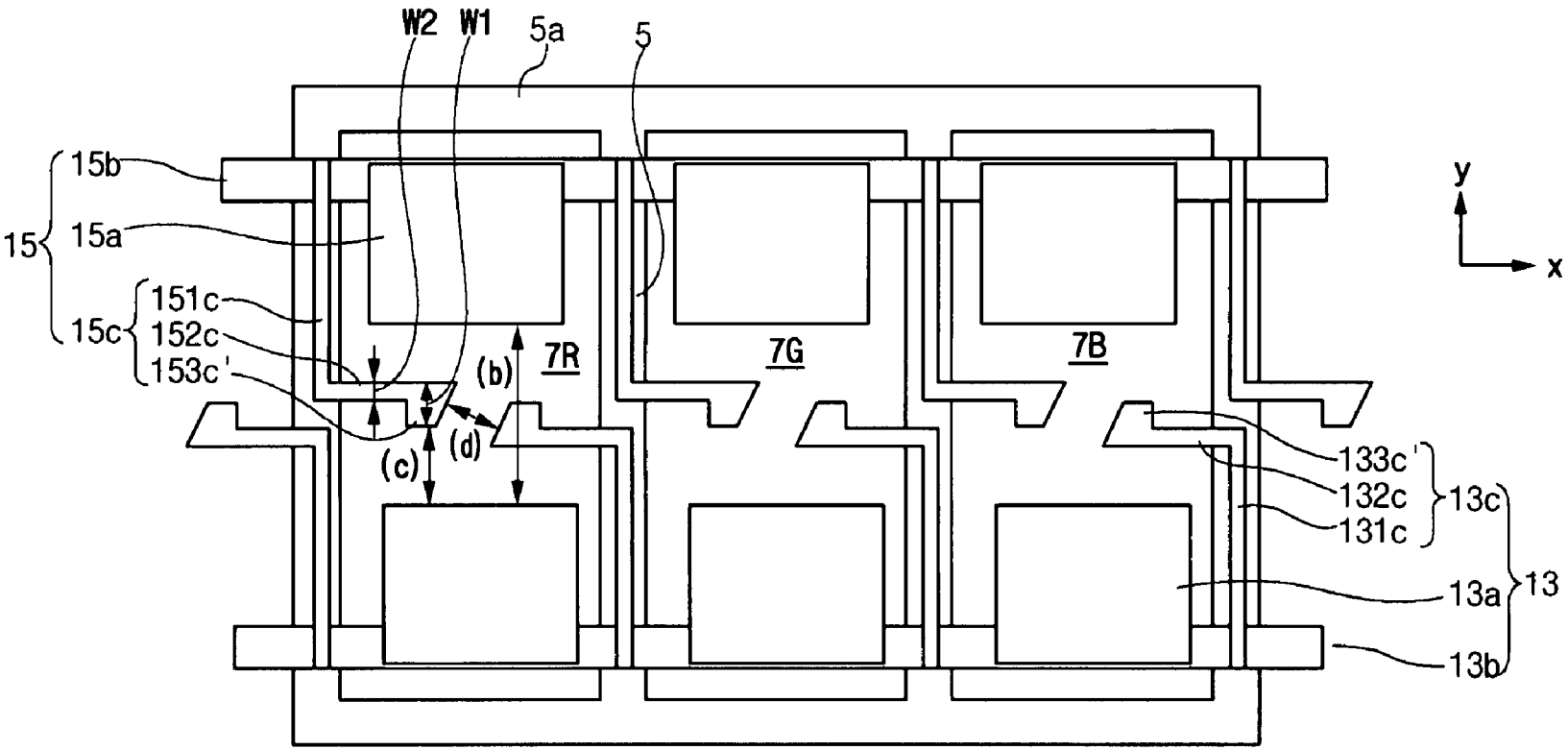
FIG. 5 is a partial plan view of a PDP according to a second embodiment of the present invention.

FIG. 5 is a partial plan view of a PDP according to a second embodiment of the present invention. The opposing portions 133*c*' and 153*c*' may be substantially perpendicular to the length direction of the address electrodes 11 (the y-axis direction of the drawing) and may have opposite sides of different lengths. In this case, the pair of opposing portions 133*c*' and 153*c*' have ends whose facing directions indicated by an arrow "d" cross the length direction of the address electrodes 11 (the y-axis direction) in a slanted manner.

As described above, the igniter electrodes 13*c* and 15*c*, which consist of the expanded portions 131*c* and 151*c*, the protruding portions 132*c* and 152*c* and the opposing portions 133*c* and 153*c* (and 133*c*' and 153*c*' for the second embodiment), are formed to correspond to the discharge cells 7R, 7G, 7B in the respective barrier ribs 5 adjacent in the direction of the length direction of the bus electrodes 13*b* and 15*b* (in the x-axis direction), the igniter electrodes 13*c* and 15*c* establishing a point of symmetry positioned about the center of the discharge cells 7R, 7G, 7B.

In addition, since the igniter electrodes 13*c* and 15*c* are positioned in luminous regions of the discharge cells 7R, 7G, 7B, in an exemplary embodiment they are transparent electrodes so as not to reduce brightness of the discharge cells 7R, 7G, 7B. In an exemplary embodiment, the protruding portions 132*c* and 152*c* and the opposing portions 133*c* and 153*c* (and 133*c*' and 153*c*' for the second embodiment) are transparent electrodes. Since the expanded portions 131*c* and 151*c* are arranged on non-luminous regions, that is, the barrier ribs 5, the expanded portions 131*c* and 151*c* can be formed with opaque electrodes.

As described above, the display electrodes 13 and 15 having the X and Y electrodes 13 and 15 further provided with the igniter electrodes 13*c* and 15*c* are covered with a second dielectric layer 19 and an MgO protective layer 21. The second dielectric layer 19 is preferably formed of a transparent dielectric material to increase transmittance of visible light.

In the PDP having the aforementioned configuration, a scan voltage is applied to the Y electrode 15 and an address voltage is applied to the address electrodes, address discharge is initiated, forming plasma within discharge cells 7R, 7G, 7B where a selected Y electrode 15 and the address electrodes 11 intersect each other. This occurs because electrons and ions in the plasma shift toward electrodes with opposite polarities, thereby permitting the flow of electric current.

Subsequently, the net potential between the Y electrode 15 and the address electrode 11 is smaller than the originally applied address voltage Va, so that the discharge become weak. Thus, the address discharge is dissipated. In such a case, a relatively small amount of electrons is deposited on the X electrode 13, while a relatively large amount of ions is deposited on the Y electrode 15. The wall charge deposited on the dielectric layer 19 covering the X and Y electrodes 13 and 15 produces a space voltage between the X and the Y electrodes 13 and 15.

If a discharge sustain voltage is applied between the X electrode 13 and the Y electrode 15, initial sustain discharge occurs at the igniter electrodes 13*c* and 15*c*, subsequently causing surface discharge to take place in two spaces among the discharge cells 7R, 7G, 7B, that is, in a space between the igniter electrode 13*c* and the protrusion electrode 15*a* and in a space between another igniter electrode 15*c* and another protrusion electrode 13*a*, which lead to surface discharge between the protrusion electrodes 13*a* and 15*a*. The VUV rays generated during sustain discharge excites phosphors in the pertinent discharge cells 7R, 7G, 7B to thus emit visible light through a front substrate.

As described above, initial sustain discharge, which has occurred between the igniter electrodes 13*c* and 15*c* with a short gap therebetween, leads to neighboring protrusion electrodes 13*a* and 15*a* spaced a short gap apart from the igniter electrodes 13*c* and 15*c*, thereby causing sustain discharge between the protrusion electrodes 13*a* and 15*a*, that is, sustain discharge can be made by low voltage driving.

As described above, in the PDP according to the present invention, a long gap is formed between protrusion electrodes of display electrodes, the protrusion electrodes having igniter electrodes, and a short gap is formed between the igniter electrodes and the protrusion electrodes while maintaining an appropriate distance between the igniter electrodes, thereby realizing sustain discharge by low voltage driving, ultimately reducing power consumption of the PDP and increasing the luminous efficiency by the long gap.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma display panel comprising:

a first substrate and a second substrate opposing each other;

barrier ribs arranged in a space between the first substrate and the second substrate to define a plurality of discharge cells;

phosphor layers in the plurality of discharge cells;

address electrodes on the second substrate; and display electrodes on the first substrate, wherein the display electrodes comprise: bus electrodes, protrusion electrodes protruding from the bus electrodes, and igniter electrodes coupled to the protrusion electrodes via the bus electrodes and having ends protruding towards insides of the discharge cells and located between and separated from the protrusion electrodes, the igniter electrodes opposing the address electrodes within the discharge cells.

2. The plasma display panel of claim 1, wherein the display electrodes comprise:

a pair of the bus electrodes on the first substrate to correspond to the discharge cells while extending along a direction intersecting a direction of the address electrodes;

the protrusion electrodes protruding toward centers of the discharge cells from respective ones of the bus electrodes; and the igniter electrodes protruding from respective opposing ones of the pair of the bus electrodes into the discharge cells having ends located between the protrusion electrodes, respectively.

3. The plasma display panel of claim 1, wherein the display electrodes comprise:

a pair of a first electrode and a second electrode of the bus electrodes on the first substrate such that the pair of the first electrode and the second electrode corresponds to respective ones of the discharge cells while extending along a direction intersecting a length direction of the address electrodes;

the protrusion electrodes protruding toward the insides of the discharge cells from respective ones of the bus electrodes; and the igniter electrodes protruding from respective opposing ones of the pair of bus electrodes and having ends located between the protrusion electrodes within the discharge cells.

4. The plasma display panel of claim 3, wherein the igniter electrodes comprise:

expanded portions extending along the barrier ribs substantially parallel to the length direction of the address electrodes protruding portions protruding from the expanded portions toward the insides of the discharge cells; and opposing portions at ends of the protruding portions, each opposing portion configured to face a respective opposing portion from an opposing one of the pair of the bus electrodes.

5. The plasma display panel of claim 4, wherein each of the opposing portions has opposite sides of the same length in the length direction of the address electrodes.

6. The plasma display panel of claim 4, wherein the pair of opposing portions have ends whose facing directions cross at right angles with respect to the length direction of the address electrodes.

7. The plasma display panel of claim 4, wherein the pair of opposing portions have ends whose facing directions cross obliquely with respect to the length direction of the address electrodes.

8. The plasma display panel of claim 4, wherein the protruding portions and the opposing portions are transparent electrodes.

9. The plasma display panel of claim 3, wherein the igniter electrodes are formed to correspond to centers of respective discharge cells.

10. The plasma display panel of claim 9, wherein the igniter electrodes are symmetric to each other about a point of symmetry positioned at the centers of the discharge cells.

11. The plasma display panel of claim 1, wherein the igniter electrodes are transparent electrodes.

12. A plasma display panel comprising:

a first substrate and a second substrate opposing each other;

barrier ribs arranged in a space between the first substrate and the second substrate to define a plurality of discharge cells;

phosphor layers in the plurality of discharge cells;

address electrodes on the second substrate; and display electrodes on the first substrate, wherein the display electrodes comprise: bus electrodes, protrusion electrodes protruding from the bus electrodes, and igniter electrodes coupled to the protrusion electrodes via the bus electrodes and having ends protruding towards insides of the discharge cells, the igniter electrodes opposing the address electrodes within the discharge cells, wherein the display electrodes comprise:

a pair of a first electrode and a second electrode of the bus electrodes on the first substrate such that the pair of the first electrode and the second electrode corresponds to respective ones of the discharge cells while extending along a direction intersecting a length direction of the address electrodes;

the protrusion electrodes protruding toward the insides of the discharge cells from respective ones of the bus electrodes; and the igniter electrodes protruding from respective opposing ones of the pair of bus electrodes and having ends located between the protrusion electrodes within the discharge cells, and wherein the igniter electrodes comprise:

expanded portions extending along the barrier ribs substantially parallel to the length direction of the address electrodes;

protruding portions protruding from the expanded portions toward the insides of the discharge cells; and opposing portions at ends of the protruding portions, each opposing portion configured to face a respective opposing portion from an opposing one of the pair of the bus electrodes, wherein the opposing portions have a width in the length direction of the address electrodes greater than a width of the protruding portions while maintaining a space therebetween.

13. A plasma display panel comprising:

a first substrate and a second substrate opposing each other;

barrier ribs arranged in a space between the first substrate and the second substrate to define a plurality of discharge cells;

phosphor layers in the plurality of discharge cells;

address electrodes on the second substrate; and display electrodes on the first substrate, wherein the display electrodes comprise: bus electrodes, protrusion electrodes protruding from the bus electrodes, and igniter electrodes coupled to the protrusion electrodes via the bus electrodes and having ends protruding towards insides of the discharge cells, the igniter electrodes opposing the address electrodes within the discharge cells, wherein the display electrodes comprise:

a pair of a first electrode and a second electrode of the bus electrodes on the first substrate such that the pair of the first electrode and the second electrode corresponds to respective ones of the discharge cells while extending along a direction intersecting a length direction of the address electrodes;

the protrusion electrodes protruding toward the insides of the discharge cells from respective ones of the bus electrodes; and the igniter electrodes protruding from respective opposing ones of the pair of bus electrodes and having ends located between the protrusion electrodes within the discharge cells, and wherein the igniter electrodes comprise:

expanded portions extending along the barrier ribs substantially parallel to the length direction of the address electrodes;

protruding portions protruding from the expanded portions toward the insides of the discharge cells; and opposing portions at ends of the protruding portions, each opposing portion configured to face a respective opposing portion from an opposing one of the pair of the bus electrodes, wherein each of the opposing portions has one relatively longer side than the opposite side in the length direction of the address electrodes.

14. A structure for initiating sustain discharge in a plasma display panel, the plasma display panel having a first substrate and a second substrate opposing each other, barrier ribs arranged in a space between the first substrate and the second substrate to define a plurality of discharge cells, phosphor layers in the plurality of discharge cells, address electrodes formed on the second substrate, and display electrodes formed on the first substrate, the display electrodes including pairs of bus electrodes with respective protrusion electrodes extending from respective bus electrodes into the discharge cells, the structure comprising:

igniter electrodes mounted to each of a respective pair of the bus electrodes, the igniter electrodes having ends distal from the respective pair of the bus electrodes, and located between and separated from the protrusion electrodes, wherein opposing faces of the ends form a substantially constant gap configured to provide an initial sustain discharge in the respective discharge cell when a discharge sustain driving voltage is applied to the display electrodes, and wherein the constant gap is extending in a direction oblique to a length direction of the address electrodes.

15. The structure of claim 14, wherein the opposing faces are located between a pair of extended portions of the protrusion electrodes such that the constant gap is extending in the direction oblique to the length direction of the address electrodes.

16. The structure of claim 14, wherein the constant gap is located at the center of a respective one of the discharge cells.

17. The structure of claim 14, wherein the igniter electrodes are transparent electrodes.

18. A plasma display panel comprising:

a first substrate;

a second substrate opposing the first substrate;

a plurality of barrier ribs between the first substrate and the second substrate to define a plurality of discharge cells;

a plurality of phosphor layers in the plurality of discharge cells;

a plurality of address electrodes on the second substrate; and a plurality of display electrodes on the first substrate, wherein the display electrodes comprise:

a first bus electrode;

a second bus electrode opposing the first bus electrode;

a first igniter electrode protruding from the first bus electrode and having a first igniter end at a center portion of a respective one of the discharge cells;

a second igniter electrode protruding from the second bus electrode and having a second igniter end at the center portion of the respective one of the discharge cells;

a first protrusion electrode protruding from the first bus electrode and having a first protrusion end facing the center portion of the respective one of the discharge cells; and a second protrusion electrode protruding from the second bus electrode and having a second protrusion end facing the center portion of the respective one of the discharge cells, wherein the first igniter end and the second igniter end are between and separated from the first protrusion electrode and the second protrusion electrode, wherein a first gap between opposing faces of the first and second igniter ends of the first and second igniter electrodes is configured to provide an initial sustain discharge in the respective one of the discharge cells, wherein a second gap between opposing faces of the first and second protrusion ends of the first and second protrusion electrodes is configured to provide a regular sustain discharge in the respective one of the discharge cells, and wherein a third gap between opposing faces of the first igniter end of first igniter electrode and the second protrusion end of second protrusion electrode or between opposing faces of the second igniter end of the second igniter electrode and the first protrusion end of the first protrusion electrode is configured to cause a surface discharge in the respective one of the discharge cells.

19. The plasma display panel of claim 18, wherein the first gap is smaller than the third gap, and wherein the third gap is smaller than the second gap.

20. The plasma display panel of claim 18, wherein the first gap is a substantially constant gap extending in a direction oblique to a length direction of the address electrodes.

* * * * *

UNITED STATES PATENT AND TRADEMARK OFFICE

CERTIFICATE OF CORRECTION

PATENT NO. : 7,728,522 B2
APPLICATION NO. : 11/131689
DATED : June 1, 2010
INVENTOR(S) : Kyoung-Doo Kang It is certified that error appears in the above-identified patent and that said Letters Patent is hereby corrected as shown below:

In the Claims

| | |
|---|---|
| Column 9, Claim 12, line 1 | Delete “towards” Insert -- toward -- |
| Column 9, Claim 13, line 44 | Delete “towards” Insert -- toward -- |

Signed and Sealed this
Thirtieth Day of August, 2011

David J. Kappos

David J. Kappos
*Director of the United States Patent and Trademark Office*